US006206712B1

(12) United States Patent
Norizuki et al.

(10) Patent No.: US 6,206,712 B1
(45) **Date of Patent: *Mar. 27, 2001**

(54) CONNECTOR COUPLING APPARATUS

(75) Inventors: Teruhisa Norizuki; Shinji Kodama; Toshiaki Okabe, all of Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/130,519

(22) Filed: Aug. 7, 1998

(30) Foreign Application Priority Data

Aug. 8, 1997 (JP) ..... 9-215123
Oct. 31, 1997 (JP) ..... 9-301003

(51) Int. Cl.[7] ..... H01R 13/64
(52) U.S. Cl. ..... 439/247
(58) Field of Search ..... 439/247, 248, 439/249, 246, 352, 353, 357, 252

(56) References Cited

U.S. PATENT DOCUMENTS 4,998,889 * 3/1991 Moly ..... 439/247
5,788,522 * 8/1998 Kameyama ..... 439/248

FOREIGN PATENT DOCUMENTS 9-55262 2/1997 (JP) .

* cited by examiner

*Primary Examiner*—Gary Paumen
*Assistant Examiner*—Alexander Gilman
(74) *Attorney, Agent, or Firm*—Oblon, Spivak, McClelland, Maier & Neustadt, P.C.

(57) ABSTRACT

One of female and male connectors is installed on a mounting base in a waiting condition through a holder such that the other connector is freely attachable to or detachable from the one connector. The one connector is provided freely slidably in the holder; the holder and one connector are engageable for maintaining the waiting condition of the one connector; the other connector is provided with a holding portion for maintaining an engagement condition when both the connectors are fit to each other and a holding releasing portion for releasing the engagement condition when the fitting of both the connectors is completed; and both the connectors are freely slidable toward the mounting base relative to the holder in a condition that the fitting is completed when the fitting of both the connectors is completed.

5 Claims, 13 Drawing Sheets

CONNECTOR COUPLING APPARATUS

BACKGROUND OF THE INVENTION

1. Field of the Invention

This invention relates to a connector coupling apparatus for example used in a vehicle door and preferable for fitting female and male connectors having multiple poles to each other and releasing them.

2. Description of the Prior Art

This kind of connector fitting structure has been disclosed in, for example, Japanese Laid Open Patent Application No. 9-55262. In the connector coupling apparatus disclosed therein, as shown in FIG. 1A, a female connector 5 provided on an electrical device is fit to a male connector 1 inserted into an insertion hole 8*a* of a connector mounting plate 8 through a mounting opening 9*a* of an instrumental panel 9. This male connector 1 has a flexible engaging piece 2. Prior to fitting of the male connector 1, a protrusion 2*a* provided on the engaging piece 2 is engaged with the insertion hole 8*a* of the connector mounting plate 8. As shown in FIGS. 1B, 1C, the female connector 5 is inserted through the mounting opening 9*a* of the instrumental panel 9 and fit to the male connector 1. As a result, when the male connector 1 is normally fit to the female connector 5, the engaging piece 2 deflects downward so that a hook portion 3 on a front end of the engaging piece 2 is embedded into a recess hole 6 of the female connector 5. When the electrical device 4 is further pressed from this condition, as shown in FIG. 1D, the male connector 1 is forced up to an assembly position, so that the female connector 5 is locked within the mounting opening 9*a* of the instrumental panel 9 through a locking piece 4*a* of the electrical device 4.

However, in the above described conventional connector fitting structure, because there is formed a tapered face 2*b* on a rear portion of the protrusion 2*a* of the engaging piece 2 of the male connector 1, the male connector 1 is likely to retract halfway when fitting together both the connectors 1, 5, so that it is difficult to install both the connectors 1, 5 at a normal position where both the connectors are fit to each other completely, thus the reliability of connection is low. Therefore, if the fitting between both the connectors 1 and 5 is released for maintenance and inspection, the male connector 1 remains drooping behind the connector mounting plate 8, so that it is impossible to fit both the connectors 1, 5 to each other when the maintenance and inspection is completed. If the wire harness connected to the male connector 1 is pulled for some reason after both the connectors 1, 5 are fit to each other, there is a fear that the fitting of both the connectors 1, 5 may be lost because there is no locking means provided between both the connectors 1 and 5. Further, because both the, connectors 1, 5 are fit to each other by only a holding force between a female terminal (not shown) of the male connector 1 and a male terminal 7 of the female connector 5, the fitting force between both the connectors 1 and 5 is insufficient so that it is weak against a vibration, thereby often producing looseness, abnormal noise and the like.

SUMMARY OF THE INVENTION

It therefore is an object of the present invention is to provide a connector coupling apparatus having a high reliability, which enables fitting of female and male connectors to each other and releasing thereof securely and easily and is capable of ensuring the fitting condition of both the connectors when they are fit to each other.

To achieve the object, a first aspect of the present invention provides a connector coupling apparatus in which one of female and male connectors is installed on a mounting base in a waiting condition through a holder such that the other connector is freely attachable to or detachable from the one connector, the connector coupling apparatus being so constructed that the one connector is provided freely slidably in the holder; the holder and one connector are provided each with an engaging means for maintaining the waiting condition of the one connector; the other connector is provided with a holding means for maintaining an engagement condition of each engaging means when both the connectors are fit to each other and a holding releasing means for releasing the engagement condition of each engaging means when the fitting of both the connectors is completed; and both the connectors are freely slidable toward the mounting base relative to the holder when the fitting of both the connectors is completed.

According to the first aspect, the engagement condition between the engaging means of the holder and the one connector is maintained securely until the fitting of both the connectors is completed by the holding means of the other connector. Therefore, the fitting of both the connectors can be ensured, thereby improving reliability. When the fitting of both the connectors is completed, the engagement condition between the engaging means of the holder and the one connector is released by the holding releasing means of the other connector. Thus, when both the connectors slide relative to the holder, it can be confirmed that the fitting of both the connectors is completed, so that it is easy to confirm the fitting condition of both the connectors.

In this connector coupling apparatus, the engagement condition between the engaging means of the holder and one connector is maintained securely until the fitting of both the connectors is completed by the holding means of the other connector. Therefore, the fitting of both the connectors is ensured, thereby improving reliability. When the fitting of both the connectors is completed, the engagement condition between the engaging means of the holder and the one connector is released by the holding releasing means of the other connector. Thus, when both the connectors slide relative to the holder, it is evident that the fitting of both the connectors is completed, so that it is easy to confirm the fitting condition of both the connectors.

According to a second aspect of the invention, there is provided a connector coupling apparatus according to the first aspect wherein the engaging means of the holder is constituted by a flexible arm having an engaging portion at a front end thereof; the engaging means of the one connector is constituted by a flexible engaging piece having an engaging portion which is fit to or released from the engaging portion of the flexible arm; the holding means and holding releasing means of the other connector are constituted by the same protrusion; and the waiting condition of the one connector is maintained by an engagement between the engaging portion of the flexible arm and the engaging portion of the flexible engaging piece.

According to the second aspect, the retraction position of the one connector in the projected waiting position is restricted by the engagement between the engaging portion of the flexible arm of the holder and the engaging portion of the flexible engaging piece of the one connector. Thus, it is easy to fit both the connectors to each other. Further, because the flexible arm of the holder and the flexible engaging piece of the one connector are disposed at the same place and the holding means and holding releasing means of the other connector are constituted by the same protrusion, the overall size of the connectors can be reduced.

In this connector coupling apparatus, the retraction position of the one connector in the projected waiting position is restricted by the engagement between the engaging portion of the flexible arm of the holder and the engaging portion of the flexible engaging piece of the one connector. Thus, it is easy to fit both the connectors to each other. Further, because the flexible arm of the holder and the flexible engaging piece of the one connector are disposed at the same place and the holding means and holding releasing means of the other connector are constituted by the same protrusion, the overall size of the connectors can be reduced.

According to a third aspect of the present invention, there is provided a connector coupling apparatus according to the second aspect wherein, when the engaging portion of the flexible arm engages with the engaging portion of the flexible engaging piece, a stopper receiving portion provided on the one connector is freely engageable with a stopper provided on the holder.

According to the third aspect, the projection position of the one connector in the projected waiting condition is restricted by the engagement between the stopper of the holder and the stopper receiving portion of the one connector. Thus, the fitting position of both the connectors can be always the same as the releasing position thereof, so that the releasing work for both the connectors for maintenance and inspection and the fitting thereof after that can be carried out easily.

In this connector coupling apparatus, the projection position of the one connector in the projected waiting condition is restricted by the engagement between the stopper of the holder and the stopper receiving portion of the one connector. Thus, the fitting position of both the connectors is always the same as the releasing position thereof, so that the releasing work for both the connectors for maintenance and inspection and the fitting thereof after that are facilitated.

According to a fourth aspect of the present invention, there is provided a connector coupling apparatus according to the first or second aspect wherein the holder has a side wall projecting for enclosing the one connector in the waiting condition.

According to the fourth aspect, because the one connector is enclosed by the side wall of the holder completely, the one connector can be protected from an external loading force or the like, so that there never occurs such a case in which the engagement condition between the engaging means of the holder and the engaging means of the one connector is lost by the external loading force or the like so that the one connector slides within the holder in such a direction of releasing the waiting condition. Therefore, the waiting condition of the one connector is maintained by the engagement between the engaging means of the holder and the engaging means of the one connector, so that the fitting thereof to the other connector can be carried out securely.

In this connector coupling apparatus, because the one connector is enclosed by the side wall of the holder completely, the one connector is protected from an external loading force or the like, so that there never occurs such a case in which the engagement condition between the engaging means of the holder and the engaging means of the one connector is lost by the external loading force or the like so that the one connector slides within the holder in such a direction of releasing the waiting condition. Therefore, the waiting condition of the one connector is maintained by the engagement between the engaging means of the holder and the engaging means of the one connector, so that the fitting thereof to the other connector is carried out securely.

According to a fifth aspect of the present invention, there is provided a connector coupling apparatus according to the fourth aspect wherein the one connector held in the waiting condition through the holder and the holder itself are divided into a plurality thereof each; and these divided connectors are located so as to wait at each deviated position in the direction of fitting to the other connectors through each holder.

According to the fifth aspect, because the divided one connector is located so as to wait at a position deviated from the divided other connector in a direction of fitting thereof to the other mating connector through each holder, the peak of total fitting force for both the female and male connectors can be diverted so that the required fitting force for both the connectors can be reduced, thereby improving the assembly performance.

In this connector coupling apparatus, a peak of total fitting force for the female and male connectors is diverted so that the required fitting force for both the connectors is reduced, thereby improving the assembly performance.

BRIEF DESCRIPTION OF THE DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
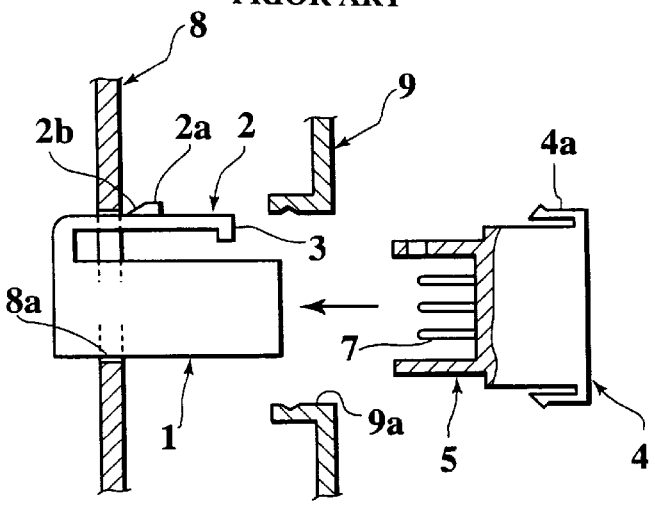
FIG.1A PRIOR ART
FIG. 1A is a sectional view of conventional female and male connectors prior to fitting.
Figure 1B:
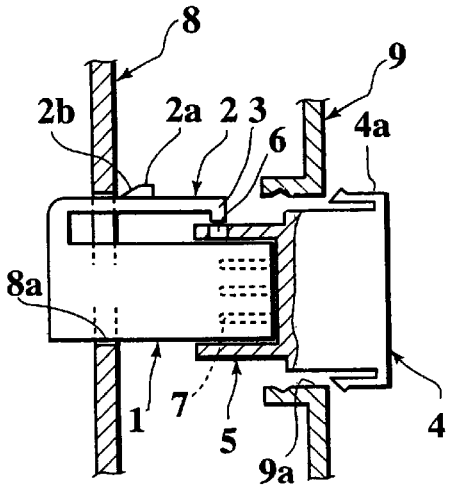
FIG.1B PRIOR ART
FIG. 1B is a sectional view of both the connectors during fitting.
Figure 1C:
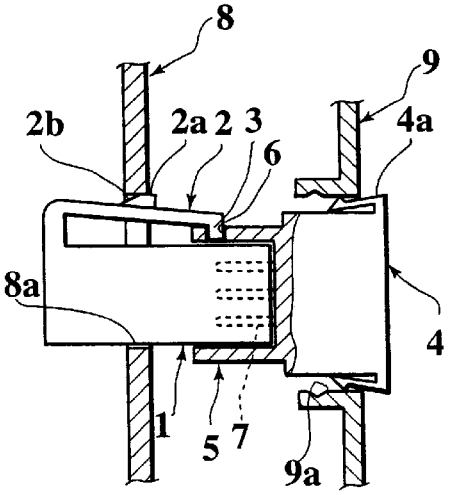
FIG.1C PRIOR ART
FIG. 1C is a sectional view showing a condition in which both the connectors are being mounted at each normal position.
Figure 1D:
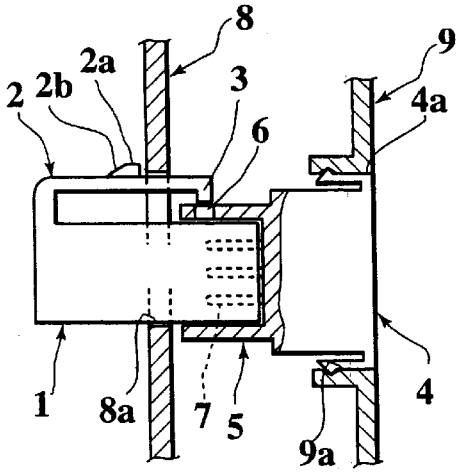
FIG.1D PRIOR ART
FIG. 1D is sectional view showing a condition in which the mounting of both the connectors is completed.

There will be detailed below the preferred embodiments of the present invention with reference to the accompanying drawings. Like members are designated by a like reference character.

Figure 2:
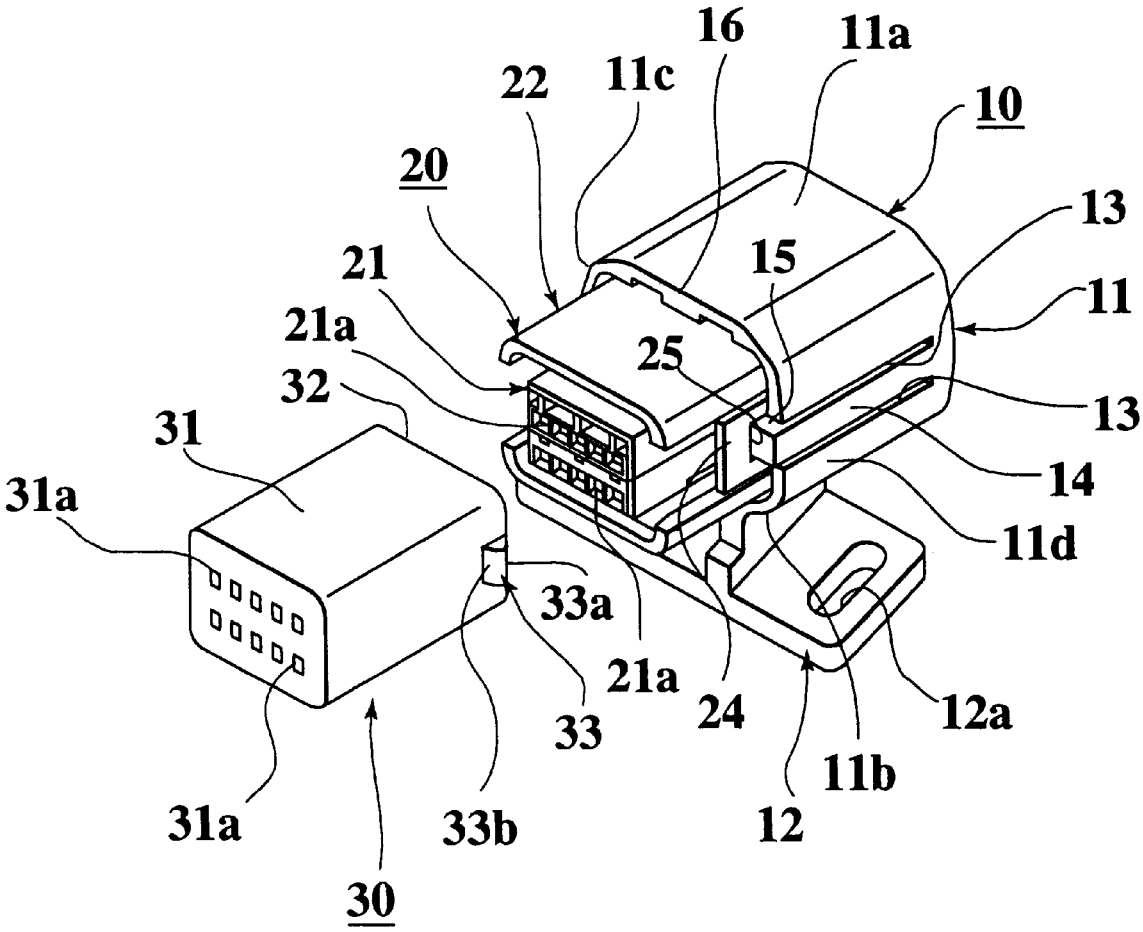
FIG. 2 is a perspective view showing a condition prior to the fitting between female and male connectors for use in a connector coupling apparatus according to an embodiment of the present invention.
Figure 4:
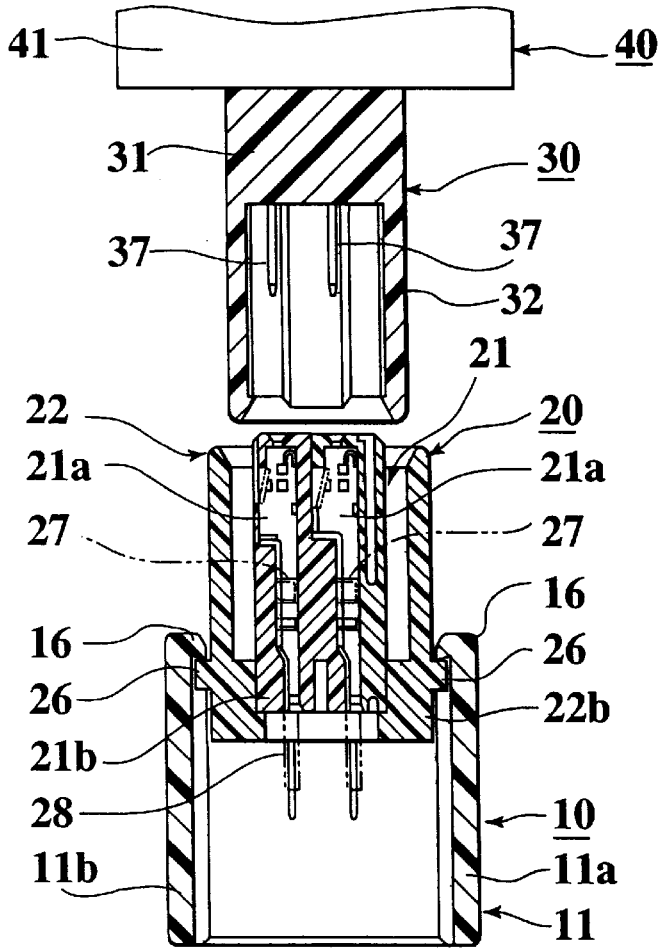
FIG. 4 is a sectional view showing a state prior to the fitting of both the connectors.
Figure 8:
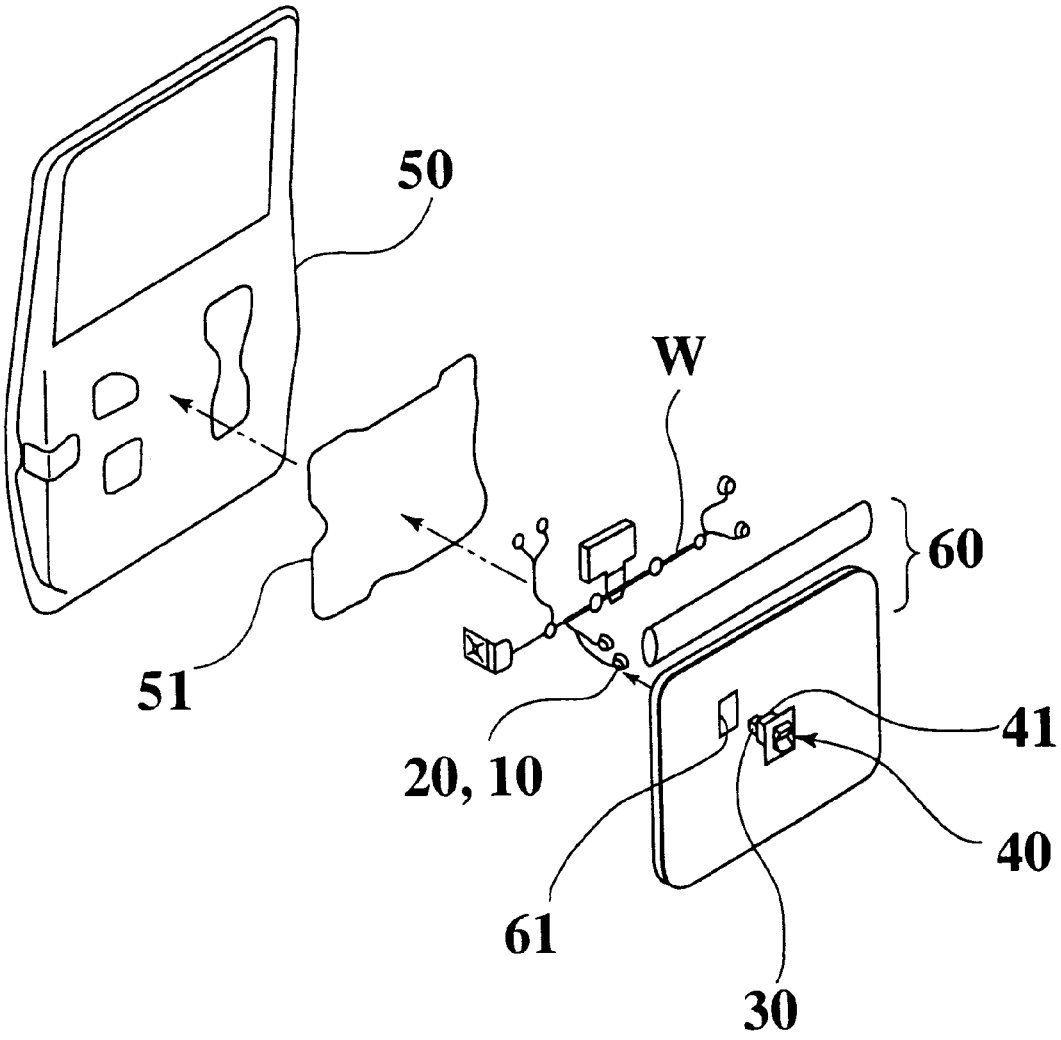
FIG. 8 is an exploded perspective view of a vehicle door employing the connector coupling apparatus.
Figure 9:
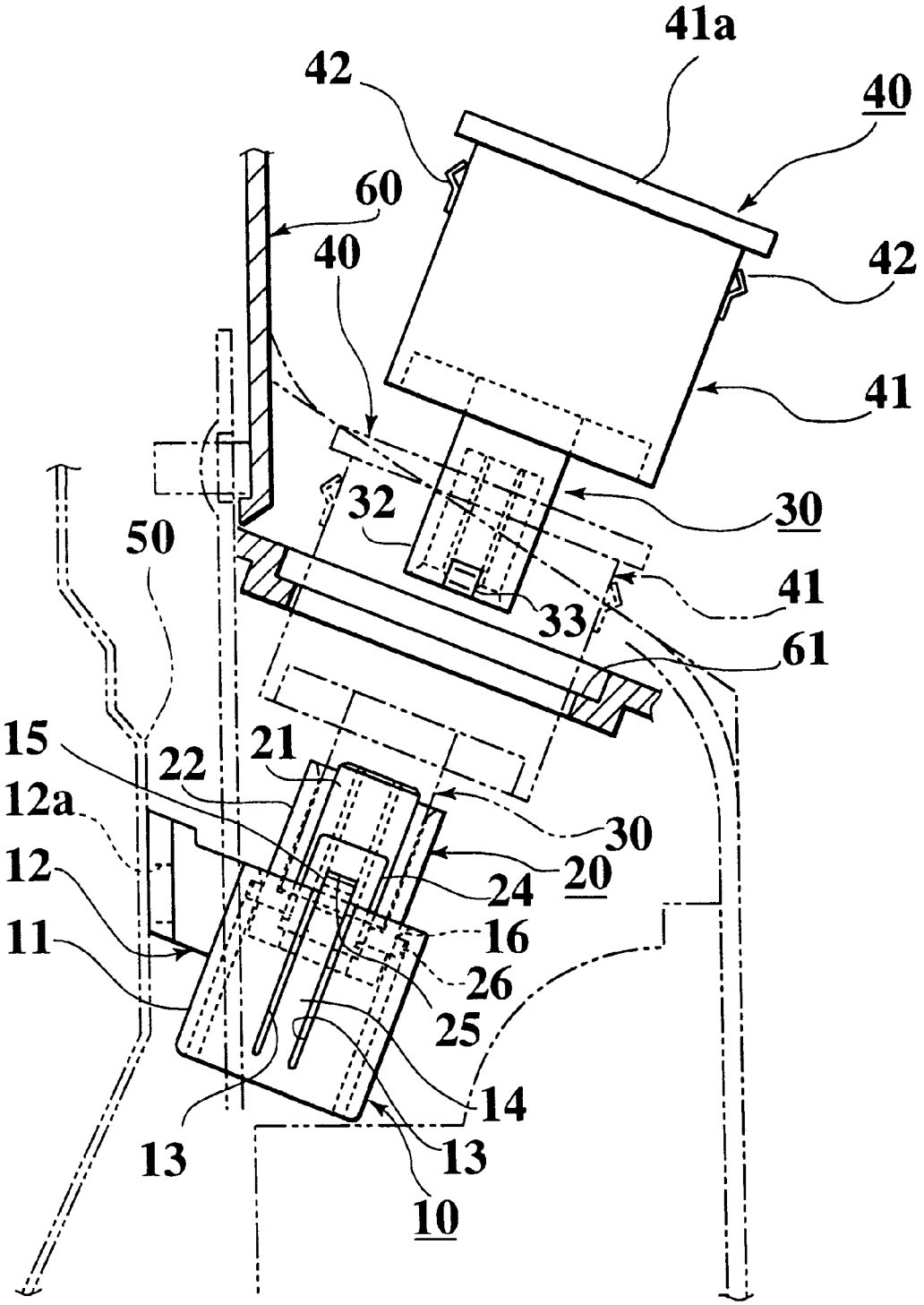
FIG. 9 is an explanatory view showing a state prior to the installation of the female and male connectors having the connector coupling apparatus employed in the above vehicle door switch.

FIG. 2 is a perspective view showing a state before fitting of a female connector and a male connector for use in a connector coupling apparatus of the present invention. FIG. 4 is a sectional view showing a state before fitting of the female connector and the male connector. FIG. 8 is an exploded perspective view of a vehicle door employing the same connector coupling apparatus. FIG. 9 is an explanatory diagram showing a state before the installation of the female connector and the male connector having the connector coupling apparatus employed in the same vehicle door.

As shown in FIGS. 2, 9, of a male connector 20 and a female connector 30 both made of synthetic resin, the male connector 20 (one connector of them) is to be installed on a door panel (mounting base) 50 in FIG. 9 through a holder 10 made of synthetic resin such that it projects. The female connector 30 is capable of being freely fit to and released from the male connector 20 projected from this holder 10. This female connector 30 is installed on a switch 41 of a switch unit 40 such as a power window switch unit or the like through a substrate (not shown). The switch unit 40 is to be installed on a switch mounting hole (switch mounting portion) 61 formed on a door trim (other mounting base) 60.

Figure 3:
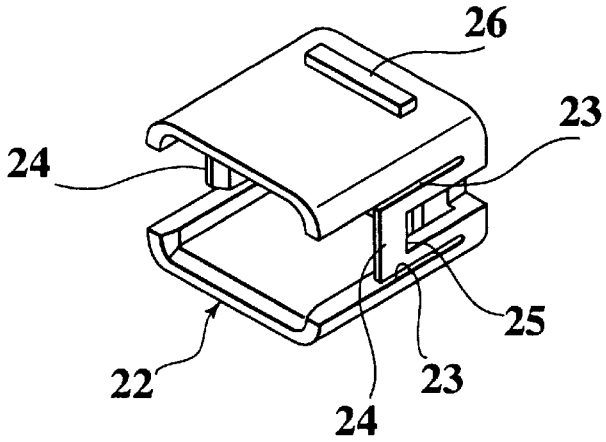
FIG. 3 is a perspective view of a hood of the male connector.
Figure 5:
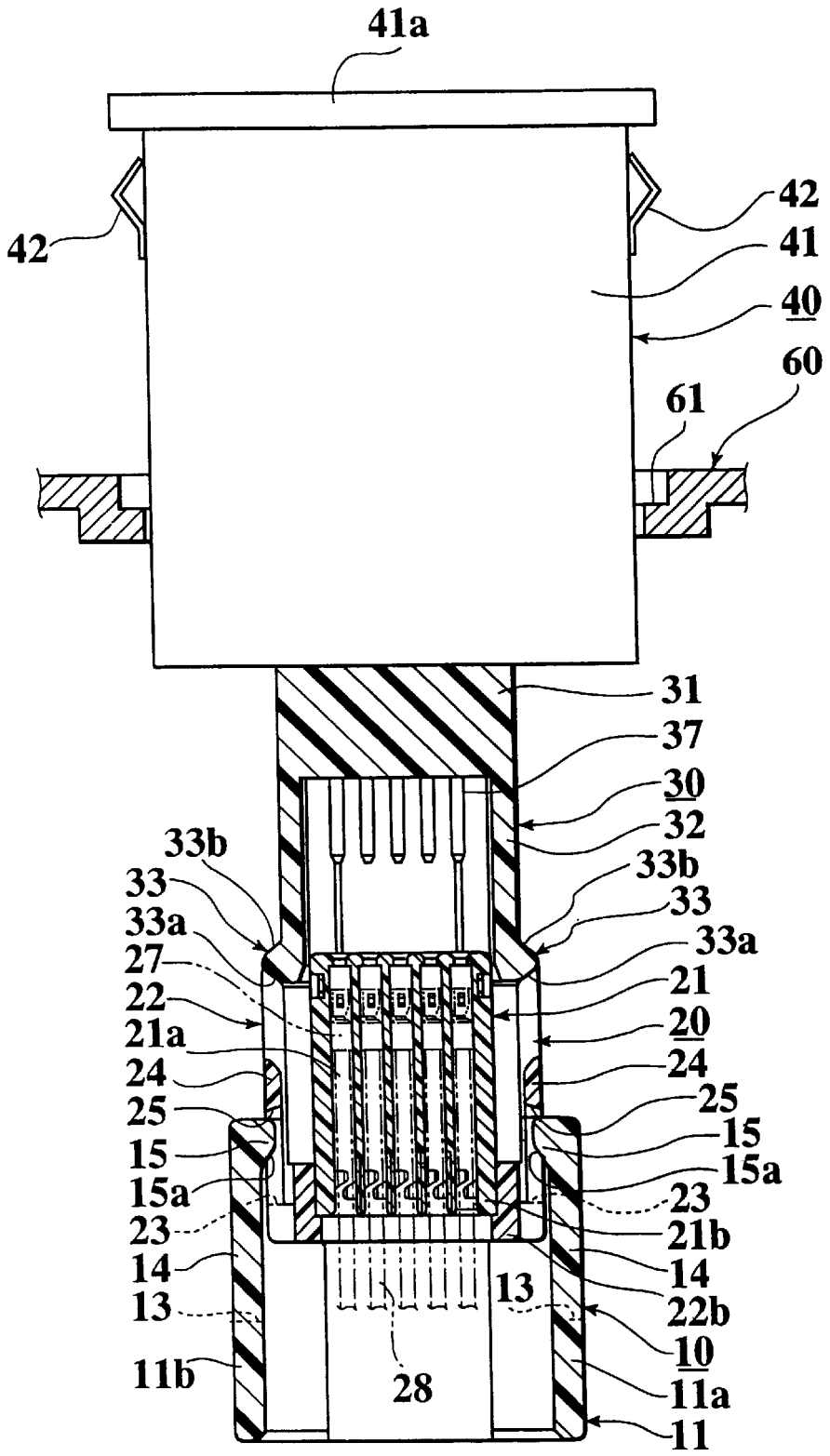
FIG. 5 is a sectional view showing a state of an initial period of the fitting of both the connectors.

As shown in FIGS. 2, 3, 5, the holder 10 comprises a cylindrical body 11 formed in the shape of a substantially rectangular cylinder with upper and lower walls 11*a*, 11*b* and left and right side walls 11*c*, 11*d* and a mounting bracket 12 formed integrally therewith so as to project from this cylindrical body. Each of the left side wall 11*c* and right side wall 11*d* has a pair of slits 13 provided in the center thereof and a L-shaped flexible arm (engaging means) 14 is formed between the pair of the slits 13 so as to project therefrom. As shown in FIG. 5, a protrusion (engaging portion) 15 having a trapezoidal section is formed inside of a front end of each of the pair of the flexible arms (engaging means) 14 so as to project therefrom. A rear portion of each protrusion 15 has a tapered face 15*a*.

As shown in FIG. 4, in the center of the front end of the inside faces of the upper wall 11*a* and lower wall 11*b* of the cylindrical body 11 of the holder 10 are formed a pair of stoppers 16 for restricting an amount of projection of the male connector 20 forward integrally with both the walls such that they project therefrom. A clearance is provided on the entire circumference between the cylindrical body 11 of the holder 10 and a hood 22 of the male connector 20 which will be described later, so that the hood 22 is supported freely slidably within the cylindrical body 11 of the holder 10. That is, when the fitting between the male connector 20 and female connector 30 is completed, both the connectors 20, 30 are freely slidable downward of the door panel with respect to the cylindrical body 11 of the holder 10 in the fitting completion condition.

Figure 7:
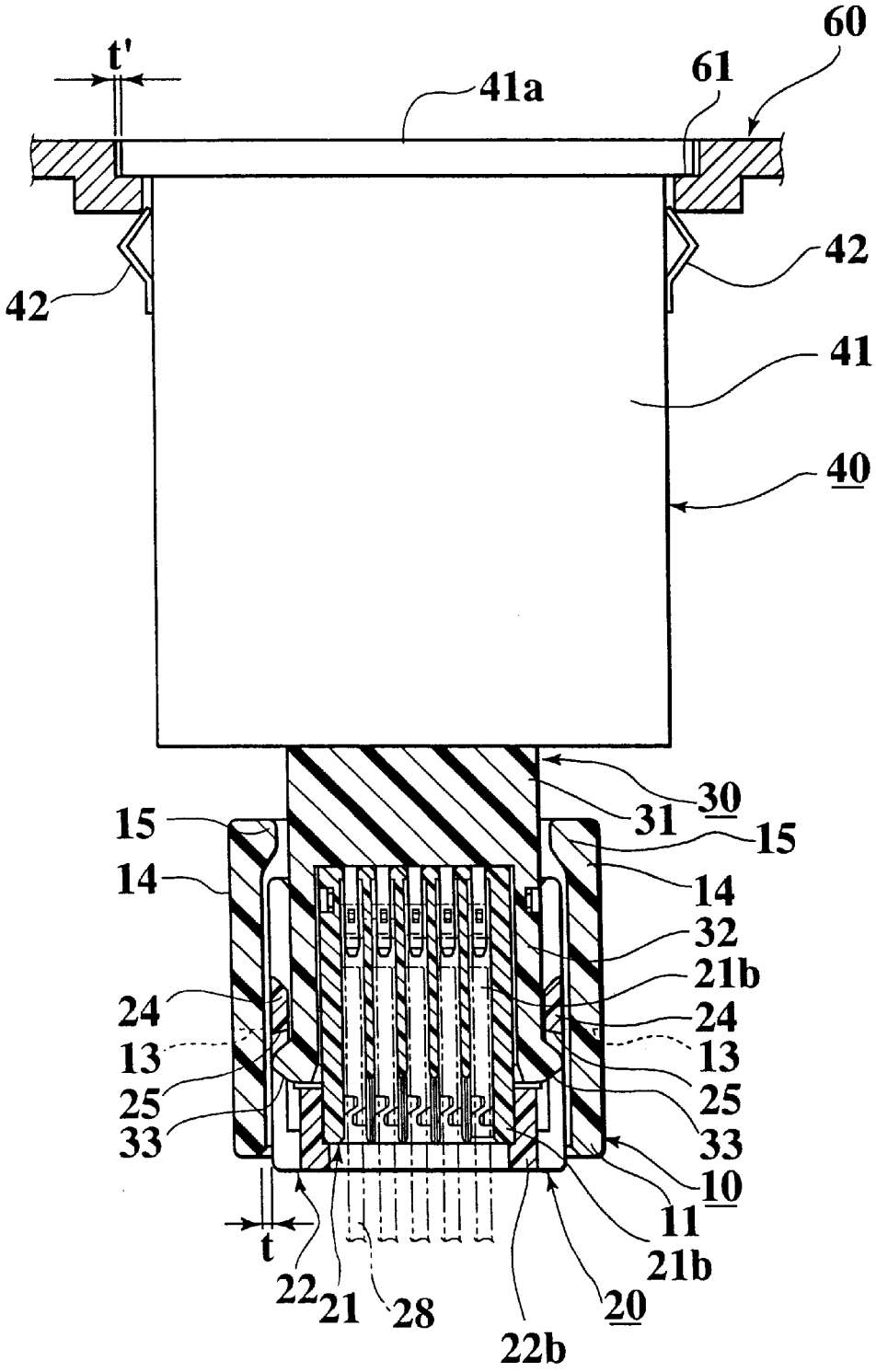
FIG. 7 is a sectional view showing a state in which the fitting of both the connectors is completed.

As shown in FIGS. 2, 4, 7, the male connector 20 comprises a housing 21 containing a plurality of chambers 21*a* for accommodating a female terminal 27 and a hood 22 for covering this housing 21. A base portion 21*b* of this housing 21 is installed in a base portion 22*b* of the hood 22 by pressure insertion such that it is centered by the base portion 22*b* of the hood 22. As shown in FIGS. 2, 3, the hood 22 is formed in the shape of a substantially rectangular cylinder with the upper and lower walls and the left and right side walls and acts as a guide for the holder 10 and the female connector 30. In the center of each of the left and right side walls of the substantially rectangular cylindrical hood 22, there are formed a pair of slits 23 and a flexible engaging piece (engaging means) 24 of a U-shape is formed integrally with each side wall between the pair of the slits 23 so that it is fit to and released from, as seen only in FIG. 2, the protrusion 15 of each flexible arm 14 of the holder 10. The width of this flexible engaging piece 24 is set so as to be larger than the width of the protrusion 15 of each flexible arm 14 and each of the flexible engaging pieces 24 is freely contactable with the left side wall 11*c* and right side wall 11*d* in the vicinity of each flexible arm 14 of the cylindrical body 11 of the holder 10.

As shown in FIG. 5, when the protrusion 15 of each flexible arm 14 of the holder 10 engages with an engaging hole 25 of each flexible engaging piece 24 of the hood 22 of the male connector 20, the male connector 20 waits for the female connector 30 to be fit thereto while being projected in a predetermined length from the holder 10. That is, because the protrusion 15 of each flexible arm 14 of the holder 10 engages with the engaging hole 25 of each flexible engaging piece 24 of the hood 22 of the male connector 20, the retraction of the male connector 20 with respect to the holder 10 is restricted. When the male connector 20 is at this waiting position while projected, both the connectors 20, 30 can be fit to or released from each other. As shown in FIGS. 3, 4, in the center of a bottom side of each of the vertical walls of the hood 22 of the male connector 20, there is formed a stopper receiving portion 26 integrally therewith such that they project therefrom. In FIG. 5, when the protrusion 15 of each flexible arm 14 of the holder 10 engages with the engaging hole 25 of each flexible engaging piece 24 of the hood 22 of the male connector 20, each stopper receiving portion 26 in FIG. 4 showing the hood 22 of the male connector 20 engages with each stopper 16 of the cylindrical body 11 of the holder 10 so that the forward projection of the male connector 20 is restricted. As shown in FIGS. 4–8, wire 28 constituting wire harness W in FIG. 8 is connected by pressure welding or crimping to a rear end of each female terminal 27 of the housing 21 of the male connector 20.

As shown in FIGS. 2, 5, 7, the female connector 30 has a base portion 31 structured in the form of blocks including a plurality of chambers 31*a* for accommodating male terminals 37 in FIG. 5 only. Its front portion is a hood portion 32 of a rectangular cylinder which is formed integrally with the base portion 31 and in which respective male terminals 37 are exposed. When both the connectors 20, 30 are fit to each other, the hood portion 32 of the female connector 30 is inserted in between the housing 21 and hood 22 of the male connector 20 so that the terminals 27, 37 of both the connectors 20, 30 are electrically connected to each other. Further, in the center of the front side of the outer surface of each of both sides of the hood portion 32 of the female connector 30, there is formed integrally therewith a protrusion 33 which acts as a means for holding the engagement between the protrusion 15 of each flexible arm 14 of the holder 10 and the engaging hole 25 of each flexible engaging piece 24 of the male connector 20 and as a holding releasing means for releasing the engagement between the protrusion 15 of each flexible arm 14 of the holder 10 and the engaging hole 25 of each flexible engaging piece 24 of the male connector 20 when the fitting between both the connectors 20 and 30 is completed or both the connectors are released from each other at the same time. This protrusion 33 is formed in the shape of a triangle and a front side thereof is a tapered face (engaging face) 33*a* and a rear side thereof is also a tapered face (releasing face) 33*b*.

Figure 11:
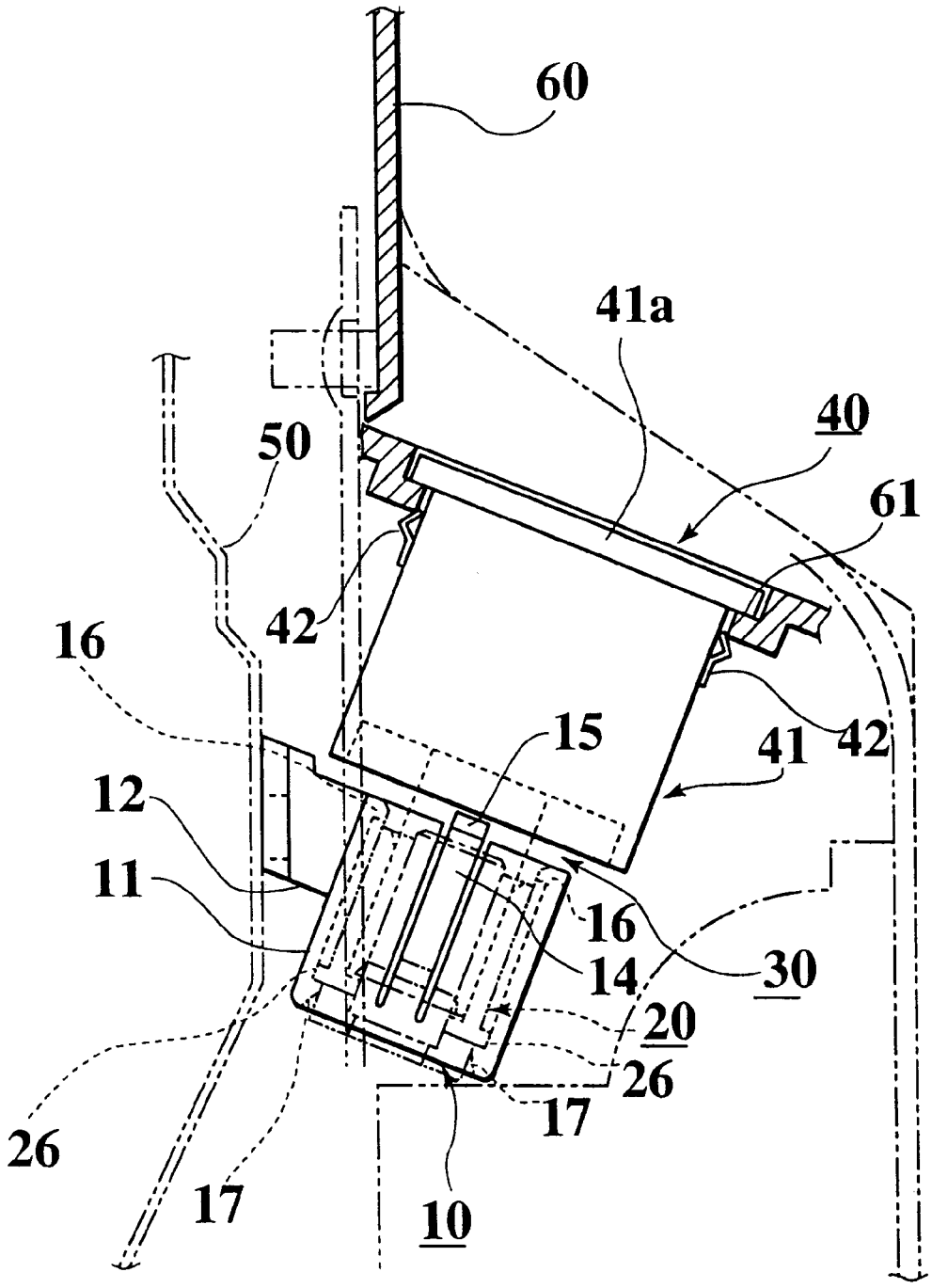
FIG. 11 is an explanatory view showing a state in which the installation of the vehicle door switch is completed.

As shown in FIGS. 5, 7, 11, a switch unit 40 comprises a switch 41, the female connector 30 fixed to this switch 41 through a substrate or the like (not shown) and leaf springs 42 (locking means) of V-shaped metal each which is fixed to a top side of each of both sides of the aforementioned switch 41 by screwing or the like for locking the switch 41 mounted in a switch mounting hole 61 of the door trim (other mounting base) 60. As shown in FIG. 7, a mounting clearance t' between the switch 41 of the switch unit 40 and the switch mounting hole 61 of the door trim 60 is set so as to be smaller than a clearance t between the cylindrical body 11 of the holder 10 and the hood 22 of the male connector 20 (t>t'). Further, as shown in FIG. 8, a waterproof sheet 51 is bonded to the door panel 50.

According to the connector coupling apparatus of the above described embodiment, when the male connector 20 on the wire harness W side of the door panel 50 is connected to the female connector 30 on the switch unit 40 side, first the waterproof sheet 51 is stretched over the door panel 50 and then the wire harness W is placed on the door panel 50 over the waterproof sheet 51. Then, the door trim 60 is installed on the door panel 50 in which the wire harness W is stretched. Then, the female connector 30 of the switch unit 40 is installed in the switch mounting hole 61 of the door trim 60 and finally, the female connector 30 is fit to the male connector 20 connected to an end of the wire harness W.

Figure 6:
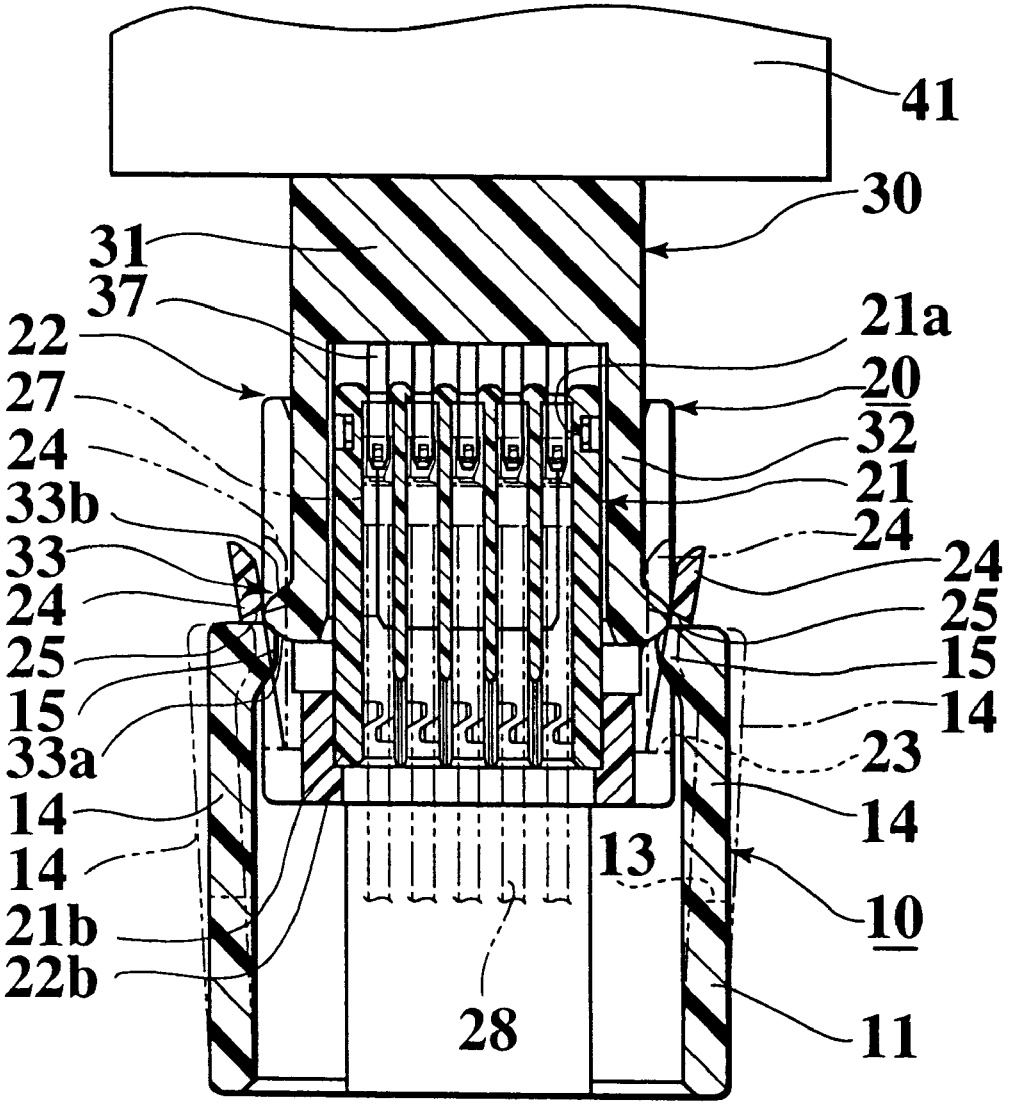
FIG. 6 is a sectional view showing a halfway condition of the fitting of both the connectors.
Figure 10:
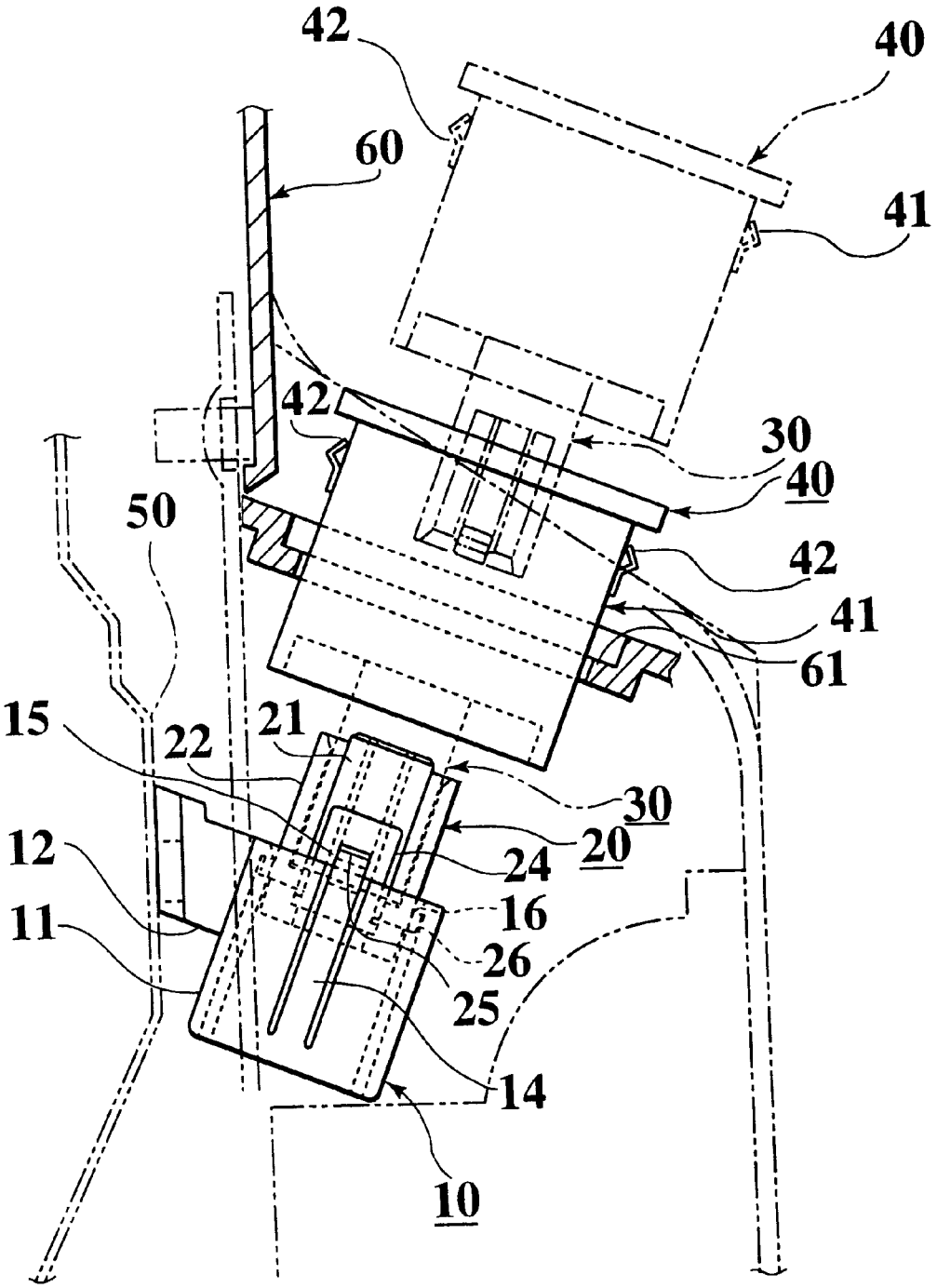
FIG. 10 is an explanatory view showing a state in which the fitting of both the connectors is completed.

In this case, as shown in FIGS. 9–11, the male connector 20 of the wire harness side is installed on the door panel 50 through the holder 10 of the male connector 20 and the male connector 20 is kept in a waiting position such that it projects towards the switch mounting hole 61 side of the door trim 60. When the switch unit 40 is installed in the switch mounting hole 61, the female connector 30 of the switch unit 40 side is fit to the male connector 20 on the wire harness side. The fitting between both the connectors 20 and 30 will be described with reference to FIGS. 5–7. In the initial state of the fitting between the male connector 20 and female connector 30 as shown in FIG. 5, the projected waiting condition of the male connector 20 is held by the engagement between the protrusion 15 of each flexible arm 14 of the holder 10 and the engaging hole 25 of each flexible engaging piece 24 of the male connector 20. In the halfway process of the fitting between the male connector 20 and the female connector 30 as shown in FIG. 6, each flexible engaging piece 24 of the male connector 20 is elastically deformed outward by a pressing force of each protrusion 33 of the female connector 30 so that the engaging hole 25 of each flexible engaging piece 24 of the male connector 20 comes into contact with a top end of each flexible arm 14 of the holder 10. Therefore, the engagement between the protrusion 15 of each flexible arm 14 of the holder 10 and the engaging hole 25 of each flexible engaging piece 24 of the male connector 20 is securely maintained.

If the fitting between both the connectors 20 and 30 is completed as shown in FIG. 7, each protrusion 33 of the female connector 30 enters the engaging hole 25 of each flexible engaging piece 24 of the male connector 20. At this time, the tapered face of each protrusion 33 of the female connector 30 presses the protrusion 15 of each flexible arm 14 of the holder 10 outward so that each of the flexible arms 14 is elastically deformed outward. As a result, the engagement between the protrusion 15 of each flexible arm 14 of the holder 10 and the engaging hole 25 of each flexible engaging piece 24 of the mate connector 20 is released, so that both the connectors 20, 30 fit in each other and slide together downward in the holder 10. If this slide is completed, the switch 41 installed in the switch mounting hole 61 of the door trim 60 is locked by an elastic urging force of the leaf spring 42 so that the installation of the switch unit 40 to the door panel is completed. At this time, both the connectors 20, 30 fit to each other and are locked by the engagement between the engaging hole 25 of each flexible engaging piece 24 of the male connector 20 and each protrusion 33 of the female connector 30. Even if the wire harness W in FIG. 8 connected to the male connector 20 is stretched for some reason after both the connectors 20, 30 are fit to each other, the fitting of both the connectors 20, 30 is never released.

If the switch 41 is pulled upward as shown in FIG. 6 when both the connectors 20, 30 are released from the fitting condition thereof for maintenance and inspection, the tapered face 33*b* of each protrusion 33 of the female connector 30 presses the protrusion 15 of each flexible arm 14 of the holder 10 outward so that each flexible arm 14 is deflected outward. As a result, each flexible engaging piece 24 of the male connector 20 is exposed from the holder 10, so that the protrusion 15 of each flexible arm 14 of the holder 10 engages with the engaging hole 25 of each flexible engaging piece 24 of the male connector 20 (this position is the same position as the projected waiting position of the male connector 20 prior to the fitting). Then, by pulling the switch 41 further upward, the female connector 30 is released from the male connector 20 smoothly. If the female connector 30 is fit to the male connector 20 again after the maintenance and inspection is completed because the male connector 20 is located at the waiting position which is projected with respect to the holder 10, it is easy to fit the female connector 30 to the male connector 20.

Because the engagement between the flexible arm 14 of the holder 10 and the flexible engaging piece 24 of the male connector 20 is maintained securely until the fitting between both the connectors 20 and 30 is completed, the fitting between both the connectors 20 and 30 can be ensured, thereby improving reliability. Also, because the engagement between the flexible arm 14 of the holder 10 and the flexible engaging piece 24 of the mate connector 20 is released by the protrusion 33 of the female connector 30 when the fitting of both the connectors 20, 30 is completed, it can be known that the fitting of both the connectors 20, 30 has been completed when both the connectors 20, 30 slide downward with respect to the holder 10, so that it is easy to confirm the fitting condition of both the connectors 20, 30. Therefore, both the connectors 20, 30 can be aligned with each other and fit to each other smoothly. Further, both the connectors 20, 30 can be slid with respect to the holder 10 easily while keeping the fitting condition of both the connectors 20, 30 when they are mounted on the door panel. Consequently, vibration and the like is prevented, thereby improving anti-vibration performance and preventing an occurrence of abnormal noise. Further, in FIG. 8, where the sliding of both the connectors 20, 30 in the fitting condition with respect to the holder 10 is completed, installation error between the door panel 50 and the door trim 60 can be absorbed, thereby preventing occurrence of looseness, vibration and generation of abnormal noise.

In FIG. 7, by the engagement between the protrusion 15 of the flexible arm 14 of the holder 10 and engaging hole 25 of the flexible engaging piece 24 of the male connector 20, the retraction position of the male connector 20 at the projected waiting position is restricted, and it is easy to fit both the connectors 20, 30 to each other. Further, because the flexible arm 14 of the holder 10 and the flexible engaging piece 24 of the male connector 20 are disposed at the same position and the further the holding means and holding releasing means of the female connector 30 are constituted by the same protrusion 33, the size of the overall connector can be reduced. Further, as seen in FIG. 4, because the forward projected waiting position of the male connector 20 is restricted by the engagement between the stopper 16 of the holder 10 and the stopper receiving portion 26 of the male connector 20, the fitting position and releasing position of both the connectors 20, 30 can be always set to the same position, so that the releasing work and the fitting work of both the connectors 20, 30 can be carried out securely at the time of maintenance and inspection.

According to the above described embodiment, the forward projected waiting position of the male connector 20 with respect to the holder 10 is restricted by the engagement between the stopper 16 on the front side of the holder 10 and the stopper receiving portion 26 on the rear side of the male connector 20. However, as shown in FIG. 17, it is permissible to restrict the retraction position of the male connector 20 with respect to the holder 10 by the engagement between the stopper 17 on the rear portion of the holder 10 and the stopper receiving portion 26 on the rear portion of the male connector 20.

Figure 12:
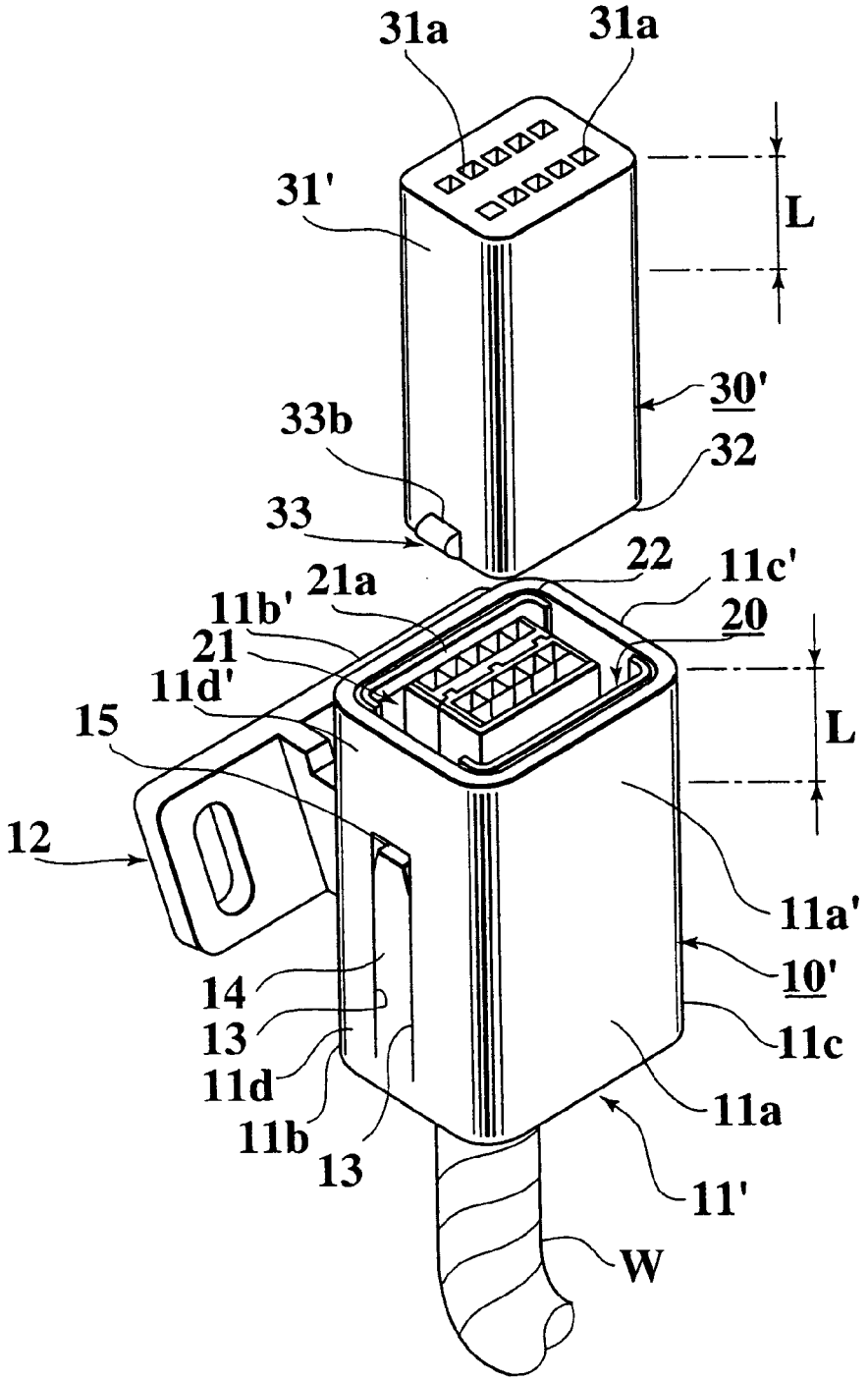
FIG. 12 is a perspective view showing a state prior to the fitting of the female and male connectors for use in the connector coupling apparatus according to the other embodiment of the present invention.
Figure 13:
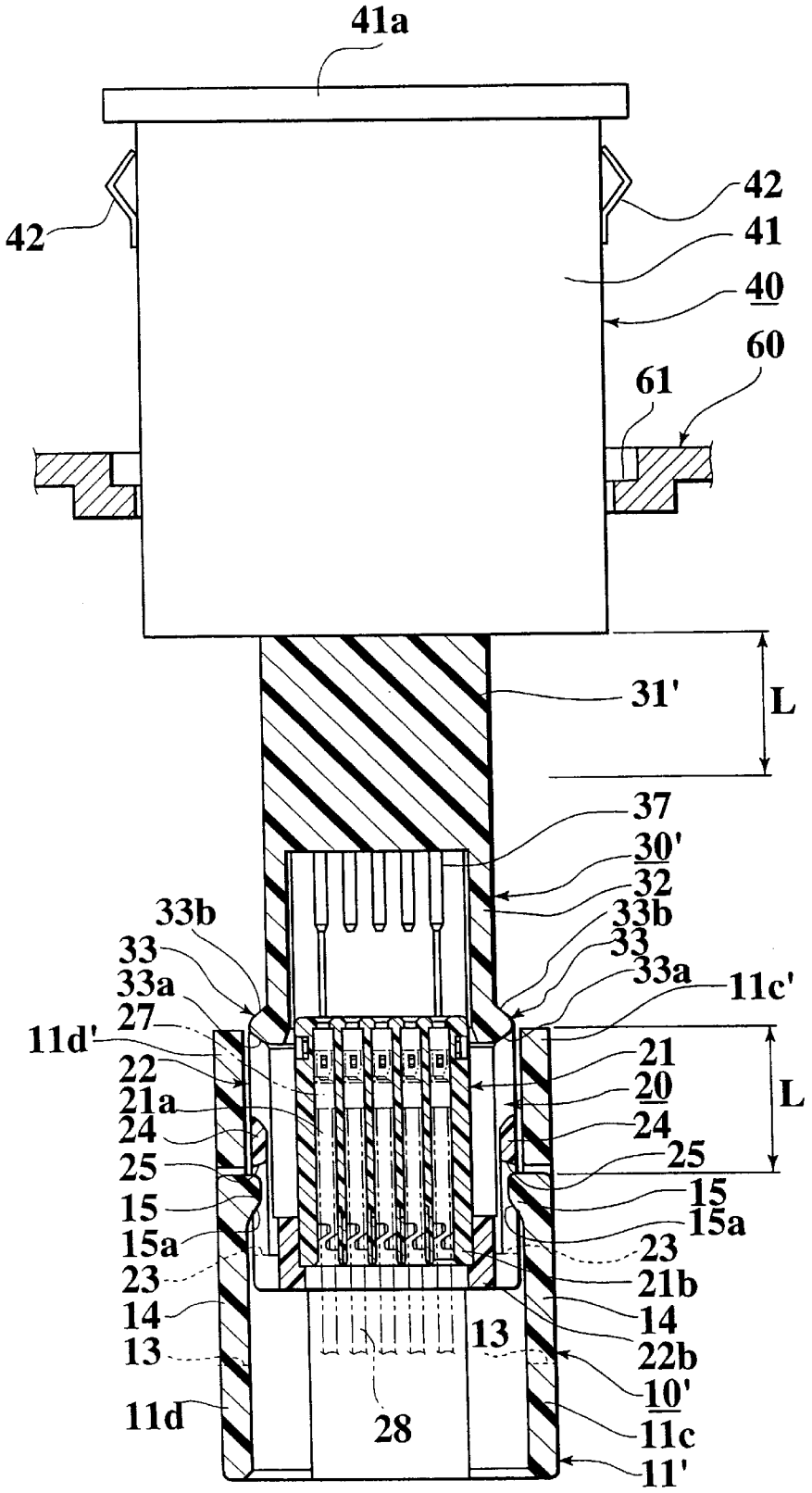
FIG. 13 is a sectional view showing a state of the initial period of the fitting between the female and male connectors according to the other embodiment.

FIG. 12 is a perspective view showing a state prior to fitting of the female and male connectors for use in the connector coupling apparatus according to other embodiment of the present invention. FIG. 13 is a sectional view showing the state of the initial period of the fitting of both the connectors.

In FIG. 12, at the front ends of the upper and lower walls 11*a*, 11*b* and left side and right side walls 11*c*, 11*d* of a cylindrical body 11' of a holder 10', there are formed extension side walls (side wall) 11*a'*, 11*b'*, 11*c'*, 11*d'* enclosing the male connector 20 (one connector) completely integrally therewith such that they project. That is, an extension portion longer by a distance L than the cylindrical body 11 of the holder 10 according to the previously described embodiment is provided so as to enclose the cylindrical body 11' of the male connector 20 completely. Further, the length of a base portion 31' of a female connector (another connector) 30' is increased by the same amount as the extension distance L. Because the other composition is the same as the previously described embodiment, the same reference numerals are attached to the same components and a description thereof is omitted.

Because, according to the connector coupling apparatus of this embodiment, the male connector 20 is enclosed completely by the extension side walls 11*a'*–11*d'* of the cylindrical body 11' of the holder 10', even if foreign matter comes into contact with the male connector 20 so that an external loading force is applied to the male connector 20 in the waiting condition shown in FIG. 13, the male connector 20 is protected by the holder 10', so that the engagement between the protrusion 15 of each flexible arm (engaging means) 14 of the holder 10' and the engaging hole 25 of each flexible engaging piece (engaging means) 24 of the male connector 20 is never lost. Therefore, there is no possibility that upon packing and placing the wire harness, the engagement between the holder 10' and the male connector 20 is lost by an external loading force or the like so that the male connector 20 drops down into the holder 10'. That is, the waiting condition of the male connector 20 is never released before it is fit to the female connector 30', so that the complete fitting between the male connector 20 and the female connector 30' can be achieved securely.

Figure 14:
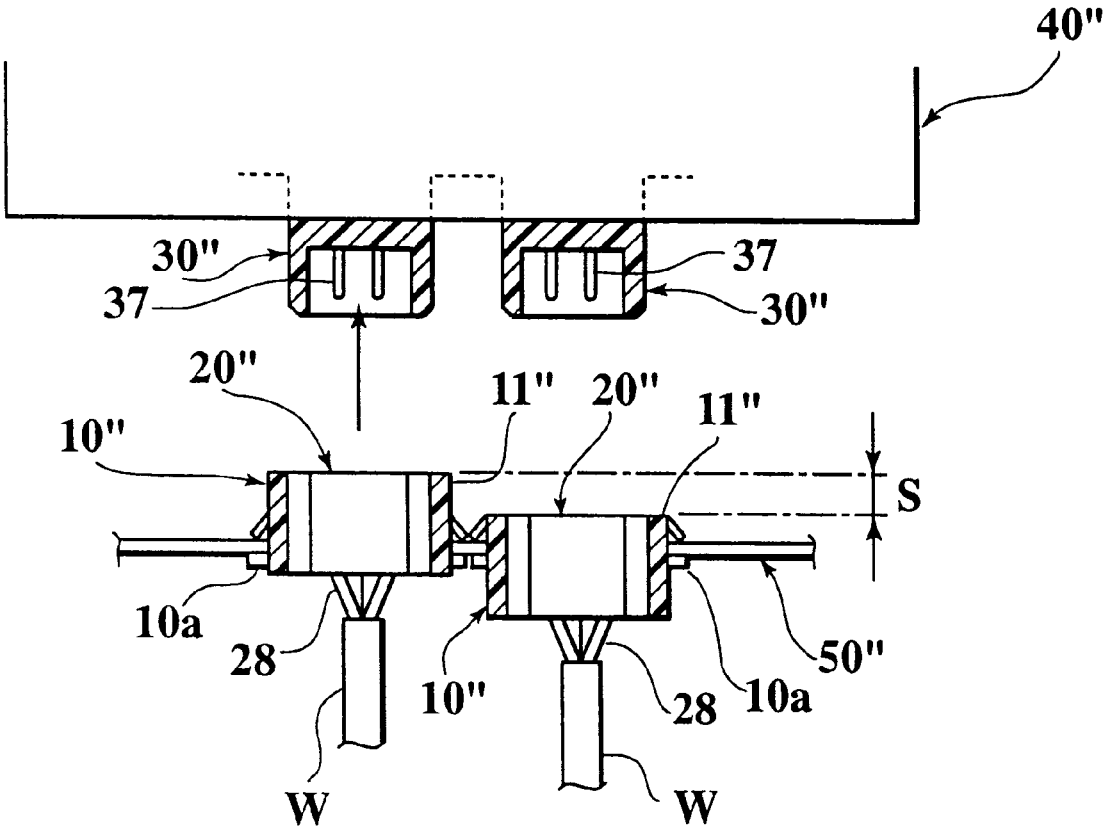
FIG. 14 is an explanatory view showing a state prior to the fitting of the female and male connectors for use in the connector coupling apparatus according to the other embodiment of the present invention.

FIG. 14 is an explanatory diagram showing a state prior to the fitting between the female and mate connectors for use in a connector coupling apparatus according to still another embodiment of the present invention.

According to this embodiment, there are provided two units of male connectors (one connector) 20" held in the waiting condition on a mounting base 50" through holders 10", and further two units of female connectors (other connector) 30" provided so as to protrude on a module portion (machine unit) 40" and in which male terminals 37 are contained. The two divided male connectors 20" wait at such a position so that they are deviated at a distance S in the direction of fitting to each female connector 30" through engaging means at a different position relative to each holder 10". The male connectors 20" are enclosed completely by peripheral walls (side wall) 11" of each holder 10".

Each holder 10" engages with each male connector 20" through each engaging means (not shown) (same structure as the combination of the protrusion 15 of the flexible arm 14 and engaging hole 25 of the flexible engaging piece 24 of the male connector 20 according to the above described embodiment). The waiting condition of each male connector 20" is maintained by this engagement. If both the connectors 20", 30" are fit to each other completely, the engagement is released so that each male connector 20" retracts relative to each holder 10". Further, the left holder 10" projected in the distance S retracts with respect to the mounting base 50" when both the right connectors 20", 30" are fit to each other. A wire 28 is connected to each male connector 20" for constituting the wire harness W.

According to the connector coupling apparatus of this embodiment, one male connector 20" is fit to one female connector 30" mounted directly on the module portion 40" and after that, the other male connector 20" is fit to the other female connector 30". Therefore, it is possible to divert a peak of total fitting force (load) for both the connectors 20", 30". As a result, the fitting force for both the connectors 20", 30" can be reduced, thereby improving the assembly performance of the module portion 40".

While preferred embodiments of the present invention have been described using specific terms, such description is for illustrative purposes, and it is to be understood that changes and variations may be made without departing from the spirit or scope of the following claims.

What is claimed is:

1. A connector coupling apparatus comprising:

a holder having a body formed in a shape of a substantially rectangular cylinder with four walls, two of which are opposed to each other and which have a pair of slits forming a flexible arm therebetween;

a male connector adapted to be engaged in the holder by each flexible arm in the two of the four walls of the holder; and a female connector adapted to be fitted into the male connector;

wherein each flexible arm has a protrusion so as to project therefrom and to engage the male connector; and wherein the male connector has four walls, two of which are opposed to each other but are aligned with the two of the four walls of the holder, each of the two walls of the male connector having a second pair of slits forming a separate flexible engaging piece that fits into and is released from the protrusion of each flexible arm of the holder.

2. A connector coupling apparatus according to claim 1, wherein each flexible arm of the holder is L-shaped and each flexible engaging piece of the male connector is U-shaped.

3. A connector coupling apparatus according to claim 2, further comprising:

a second holder attached to the holder;

a second male connector engaged in the second holder; and a second female connector fitted into the second male connector.

4. A connector coupling apparatus, comprising:

a holder having a body formed in a shape of a substantially rectangular cylinder with four walls, two of which are opposed to each other and which have a pair of slits forming a flexible arm therebetween;

a male connector adapted to be engaged in the holder by each flexible arm in the two of the four walls of the holder; and a female connector adapted to be fitted into the male connector;

wherein each flexible arm has a protrusion so as to project therefrom and to engage the male connector;

wherein the male connector has four walls, two of which are opposed to each other, each of the two walls of the male connector having a second pair of slits forming a separate flexible engaging piece that fits into and is released from the protrusion of each flexible arm of the holder;

wherein the female connector has a pair of projections, each of which corresponds to the protrusion and the flexible engaging piece;

wherein the protrusion comes in contact with the flexible engaging piece so as to prevent the male connector from fitting into the holder; and wherein, when the female connector fits into the male connector, the projection deforms the protrusion so as to part from the flexible engaging piece, whereby the protrusion permits the male connector to fit into the holder.

5. A connector coupling apparatus, comprising:

a holder having two walls which are opposed to each other and which have a pair of slits forming a flexible arm therebetween;

a male connector adapted to be engaged in the holder by each flexible arm in the two walls of the holder; and a female connector adapted to be fitted into the male connector;

wherein each flexible arm has a protrusion so as to project therefrom and to engage the male connector;

wherein the male connector has two walls which are opposed to each other, said two walls of the male connector having a second pair of slits forming a separate flexible engaging piece that fits into and is released from the protrusion of each flexible arm of the holder;

wherein the female connector has a pair of projections, each of which corresponds to the protrusion and the flexible engaging piece;

wherein the protrusion comes in contact with the flexible engaging piece so as to prevent the male connector from fitting into the holder;

wherein, when the female connector fits into the male connector, the projection deforms the protrusion so as to part from the flexible engaging piece, whereby the protrusion permits the male connector to fit into the holder.

* * * * *

UNITED STATES PATENT AND TRADEMARK OFFICE

CERTIFICATE OF CORRECTION

PATENT NO. : 6,206,712 B1
DATED : March 27, 2001
INVENTOR(S) : Teruhisa Norizuki et al.

It is certified that error appears in the above-identified patent and that said Letters Patent is hereby corrected as shown below:

Column 1,
Line 51, delete "," (second occurrence).

Column 5,
Line 41, delete "a".

Column 6,
Line 46, change "of" (first occurrence) to -- shown in Fig. 4 for --.

Column 9,
Line 3, delete ","; and
Line 7, delete "the" (first occurrence); after "and" (second occurrence), insert "the".

Signed and Sealed this

Eleventh Day of December, 2001

*Attest:*

Nicholas P. Godici

*Attesting Officer*

NICHOLAS P. GODICI
*Acting Director of the United States Patent and Trademark Office*